US010408098B2

(12) United States Patent
Sarwar et al.

(10) Patent No.: US 10,408,098 B2
(45) Date of Patent: Sep. 10, 2019

(54) METHOD OF DIAGNOSING A LUBRICATION SYSTEM OF AN ENGINE

(71) Applicant: GM GLOBAL TECHNOLOGY OPERATIONS LLC, Detroit, MI (US)

(72) Inventors: Azeem Sarwar, Rochester Hills, MI (US); Syed B. Mehdi, Urbana, IL (US); Xiangxing Lu, Sterling Heights, MI (US); Bryan K. Pryor, Waterford, MI (US); Shanshan L. Peer, Milford, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 238 days.

(21) Appl. No.: 15/668,756

(22) Filed: Aug. 4, 2017

(65) Prior Publication Data

US 2019/0040775 A1 Feb. 7, 2019

(51) Int. Cl.

| | |
|---|---|
| ***F01M 11/10*** | (2006.01) |
| ***F01M 1/02*** | (2006.01) |
| ***F01M 1/16*** | (2006.01) |

(52) U.S. Cl.

CPC ..... *F01M 11/10* (2013.01); *F01M 1/02* (2013.01); *F01M 1/16* (2013.01); *F01M 2011/142* (2013.01); *F01M 2011/1446* (2013.01)

(58) Field of Classification Search

CPC . F01M 11/10; F01M 1/16; F01M 1/02; F01M 2011/142; F01M 2011/1446

See application file for complete search history.

(56) References Cited

U.S. PATENT DOCUMENTS

2012/0055146 A1* 3/2012 Baraga ..... F16H 61/0031 60/327
2013/0180480 A1* 7/2013 Rollinger ..... F01L 1/3442 123/90.15
2016/0108774 A1* 4/2016 Pietrzyk ..... F01L 1/34409 123/90.1
2016/0363120 A1* 12/2016 Meinig ..... F04C 2/344

* cited by examiner

*Primary Examiner* — Mary Cheung
(74) *Attorney, Agent, or Firm* — Quinn IP Law

(57) ABSTRACT

A method of diagnosing a lubrication system of an engine includes controlling an oil pump with a control signal. The control signal is a command having a value for a desired lubrication fluid pressure from the oil pump for a current operating state of the engine. A processing unit compares the value of the control signal for the current operating state of the engine to a threshold control value for the current operating state of the engine. When the processing unit determines that the value of the control signal for the current operating state of the engine deviates from the threshold control value for the current operating state of the engine, the processing unit analyzes the value of the control signal to identify a fault in the lubrication system.

20 Claims, 2 Drawing Sheets

METHOD OF DIAGNOSING A LUBRICATION SYSTEM OF AN ENGINE

INTRODUCTION

The disclosure generally relates to a method of diagnosing a lubrication system of an engine.

Engines include a lubrication system having an oil pump that circulates a lubrication fluid e.g., oil, through an oil gallery of the engine. As used herein, the term "oil gallery" includes not only the passages in the engine through which the lubrication fluid circulates, but also the surfaces between moving parts for which the lubrication fluid lubricates. Accordingly, the oil gallery includes bearing surfaces, piston rings, cylinder bores, passages, etc. The oil pump pressurizes the lubrication fluid to a desired lubrication fluid pressure, and circulates the lubrication fluid through the oil gallery. The desired lubrication fluid pressure may vary for different operating conditions of the engine, and should be maintained during engine operation.

A vehicle controller is connected to the oil pump, and signals the oil pump with a control signal. The control signal is a command having a value. The control signal controls the oil pump to provide the desired lubrication fluid pressure for the current operating conditions of the engine. The vehicle controller controls the oil pump to provide different lubrication fluid pressures for different operating conditions of the engine by adjusting the value of the control signal.

Wear in the oil pump and/or the oil gallery, such as wear in the vanes of the oil pump, or wear between bearing surfaces or between piston rings and the cylinder bores, may affect the fluid pressure in the lubrication system. Additionally, a blockage in the oil gallery may affect the fluid pressure in the lubrication system. The vehicle controller monitors the actual lubrication fluid pressure in the oil gallery, and adjusts the value of the control signal to provide the desired lubrication fluid pressure. For example, if the actual lubrication fluid pressure in the oil gallery decreases for a specific operating condition of the engine, due to excessive wear for example, the vehicle controller may adjust the value of the control signal to the oil pump to increase the lubrication fluid pressure to achieve the desired lubrication fluid pressure for that operating condition of the engine.

SUMMARY

A method of diagnosing a lubrication system of an engine is provided. The method includes controlling an oil pump with a control signal from a vehicle controller. The control signal is a command having a value for a desired lubrication fluid pressure from the oil pump for a current operating state of the engine. a processing unit compares the value of the control signal for the current operating state of the engine to a threshold control value for the current operating state of the engine to determine if the value of the control signal for the current operating state of the engine is substantially equal to the threshold control value for the current operating state of the engine, or if the value of the control signal for the current operating state of the engine deviates from the threshold control value for the current operating state of the engine. When the processing unit determines that the value of the control signal for the current operating state of the engine deviates from the threshold control value for the current operating state of the engine, the processing unit analyzes the value of the control signal to identify a fault in the lubrication system.

In one embodiment of the method, the value of the control signal for the current operating state of the engine is substantially equal to the threshold control value for the current operating state of the engine when the value of the control signal is within +/−15% of the threshold control value. The percentage difference may vary. Accordingly, in other embodiments, the value of the control signal from the current operating state of the engine is substantially equal to the threshold control value for the current operating state of the engine when the value of the control signal is +/− a pre-defined percentage based on the specific application.

In one aspect of the method, analyzing the value of the control signal to identify a fault in the lubrication system includes tracking at least one operating condition of the engine relative to the value of the control signal. The at least one operating condition of the engine includes at least one of a rotational speed of the engine, the desired lubrication fluid pressure from the oil pump, an actual lubrication fluid pressure from the oil pump, and a lubrication fluid temperature.

In another aspect of the method, the processing unit may normalize the value of the control signal for the current operating state of the engine based on a current lubrication fluid temperature.

In another aspect of the method, analyzing the value of the control signal to identify a fault in the lubrication system includes determining if the value of the control signal is greater than the threshold control value with the engine operating in a low lubrication fluid pressure regime and if the value of the control signal is less than the threshold control value with the engine operating in a high lubrication fluid pressure regime. When the processing unit determines that the value of the control signal is greater than the threshold control value with the engine operating in the low lubrication fluid pressure regime and that the value of the control signal is less than the threshold control value with the engine operating in the high lubrication fluid pressure regime, the processing unit may calculate a fault severity. When the fault severity is greater than a severity threshold, the processing unit may issue a notification indicating excessive control chamber clearance in the oil pump.

In another aspect of the method, when the processing unit determines that the value of the control signal is not greater than the threshold control value with the engine operating in the low lubrication fluid pressure regime, or the value of the control signal is not less than the threshold control value with the engine operating in the high lubrication fluid pressure regime, then the processing unit determines if the value of the control signal deviates from the threshold control value only at low rotational speeds of the engine with the engine operating in the high lubrication fluid pressure regime. When the processing unit determines that the value of the control signal does not deviate from the threshold control value only at low rotational speeds of the engine with the engine operating in the high lubrication fluid pressure regime, then the processing unit issues a notification indicating an un-identified fault with the lubrication system.

In another aspect of the method, when the processing unit determines that the value of the control signal deviates from the threshold control value only at low rotational speeds of the engine with the engine operating in the high lubrication fluid pressure regime, then the processing unit compares a remaining oil life percentage to an oil life threshold to determine if the remaining oil life percentage is greater than the oil life threshold, or if the remaining oil life percentage is not greater than the oil life threshold. When the processing unit determines that the remaining oil life percentage is not greater than the oil life threshold, then the processing unit issues a notification indicating an advised oil change.

In another aspect of the method, when the processing unit determines that the remaining oil life percentage is greater than the oil life threshold, then the processing unit may calculate a fault severity. Additionally, when the processing unit determines that the remaining oil life percentage is greater than the oil life threshold, then the processing unit determines if the value of the control signal is less than the threshold control value at low rotational speeds of the engine. When the processing unit determines that the value of the control signal is not less than the threshold control value at low rotational speeds of the engine, and when the fault severity is greater than a severity threshold, the processing unit issues a notification indicating an obstruction in an oil gallery of the engine. When the processing unit determines that the value of the control signal is less than the threshold control value at low rotational speeds of the engine, and when the fault severity is greater than a severity threshold, then the processing unit issues a notification indicating excessive clearance in the oil gallery of the engine or in pump vanes of the oil pump.

A vehicle is also provided. The vehicle includes an engine having an oil gallery and a lubrication system having an oil pump operable to circulate a lubrication fluid through the oil gallery of the engine. A processing unit is in communication with the oil pump. The processing unit is operable to diagnose the oil pump. The processing unit includes a processor and a memory having a lubrication system diagnostic algorithm stored therein. The processor is operable to execute the lubrication system diagnostic algorithm to execute the method of diagnosing the lubrication system of the engine described above.

The method of diagnosing the lubrication system of the engine is a new, unique method that analyzes the change in the value of the control signal used to control the oil pump for different operating conditions of the engine to identify different faults in the lubrication system. This new method of diagnosing the lubrication system enables the processing unit to identify specific components of the lubrication system that may need service, thereby improving the diagnostic capabilities of the processing unit.

The above features and advantages and other features and advantages of the present teachings are readily apparent from the following detailed description of the best modes for carrying out the teachings when taken in connection with the accompanying drawings.

DETAILED DESCRIPTION

Those having ordinary skill in the art will recognize that terms such as "above," "below," "upward," "downward," "top," "bottom," etc., are used descriptively for the figures, and do not represent limitations on the scope of the disclosure, as defined by the appended claims. Furthermore, the teachings may be described herein in terms of functional and/or logical block components and/or various processing steps. It should be realized that such block components may be comprised of a number of hardware, software, and/or firmware components configured to perform the specified functions.

Figure 1:
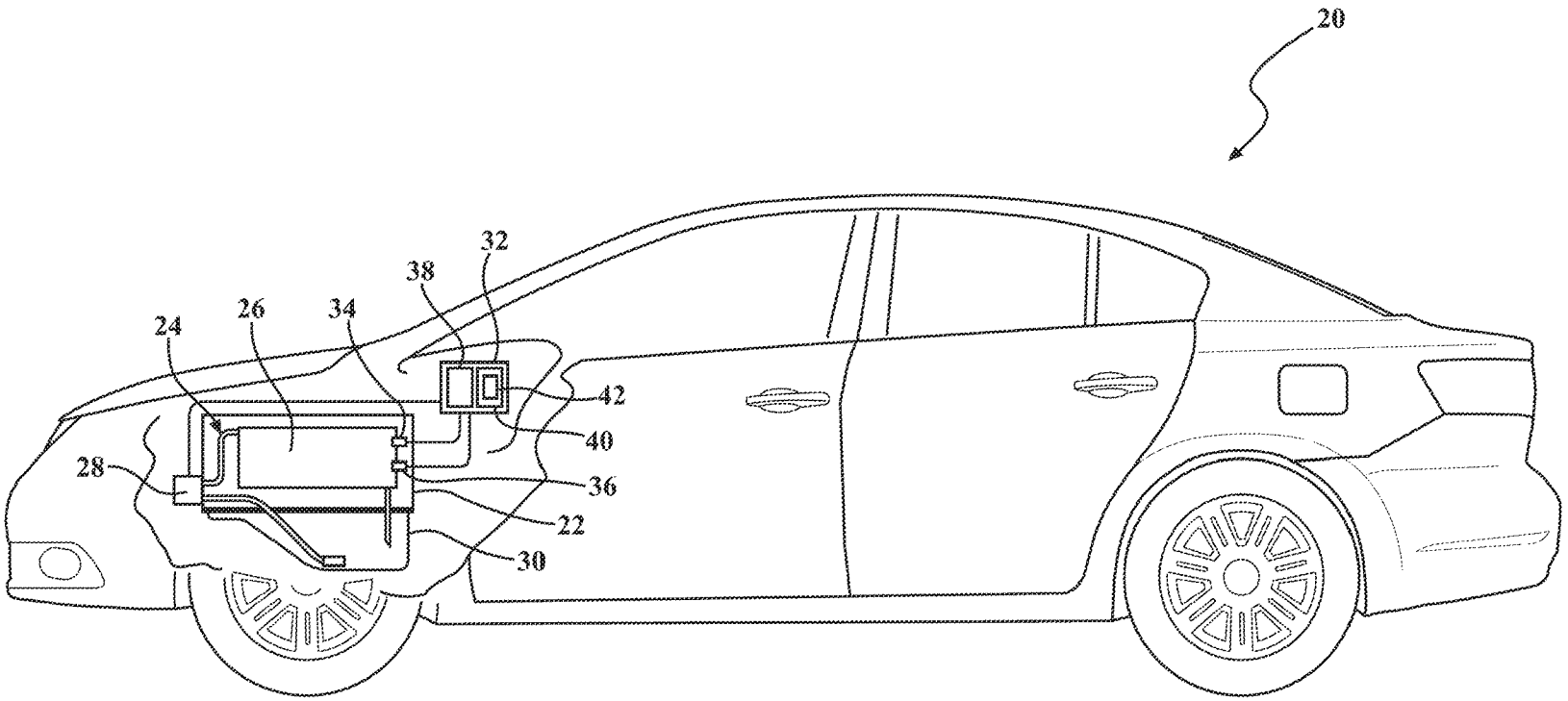
FIG. 1 is a schematic side view of a vehicle.

Referring to the FIGS., wherein like numerals indicate like parts throughout the several views, a vehicle is generally shown at 20 in FIG. 1. The vehicle 20 may include a type of moveable platform, including but not limited to a car, truck, a train, an ATV, a boat, a plane, etc.

Referring to FIG. 1, the vehicle 20 includes an engine 22. The engine 22 may include a type and/or configuration of engine 22 that includes a lubrication system 24. Unless otherwise described herein, the specific type, construction, operation, and style of engine 22 is not pertinent to the teachings of this disclosure, and are therefore not described in detail herein.

As shown in FIG. 1, the engine 22 includes an oil gallery 26. As used herein, the term "oil gallery" includes passages as well as lubricated surfaces that are supplied with a lubrication fluid, e.g., motor oil, through the passages. The lubricated surfaces may include, but are not limited to, bearings and bearing surfaces, piston rings and cylinder bores, etc. The engine 22 includes an oil pump 28 that is operable to pressurize and circulate a lubrication fluid, e.g., motor oil, through the oil gallery 26. The oil pump 28 draws the lubrication fluid from a sump 30, and circulates it through the oil gallery 26. The lubrication fluid is returned to the sump 30 to complete the fluid circuit. The oil pump 28 is actively controlled by a vehicle controller to provide a desired lubrication fluid pressure. As such, the oil pump 28 may be referred to as a continuously variable displacement pump. The oil pump 28 may include a device that is capable of pressurizing and circulating the lubrication fluid, and that is actively controlled by a control signal to provide a desired fluid pressure. The vehicle controller sends the electronic control signal to the oil pump 28 to adjust the lubrication fluid pressure. Accordingly, the control signal includes a variable or adjustable value.

As shown in FIG. 1, the engine 22 may include a pressure sensor 34 that is operable to sense a lubrication fluid pressure in the oil gallery 26. The pressure sensor 34 is disposed in communication with a processing unit 32 to transmit data related to the fluid pressure of the lubrication fluid in the oil gallery 26 to the processing unit 32. The engine 22 may further include a temperature sensor 36 operable to sense a temperature of the lubrication fluid. The temperature sensor 36 is also in communication with the processing unit 32 to transmit data to the processing unit 32 regarding the temperature of the lubrication fluid.

The processing unit 32 may be referred to generally as a computer, a controller, a control module, and may be referred to more specifically as an engine control unit, an engine control module, an engine controller, a diagnostic controller, a diagnostic control module, a vehicle controller, etc. The processing unit 32 is operable to diagnose the operation of the engine 22, including the lubrication system 24. In some embodiments, the processing unit 32 may be located onboard the vehicle 20 and be integrated with a vehicle controller for controlling the engine 22. In other embodiments, the processing unit 32 may be located remotely from the vehicle 20, and the required data is transmitted from the vehicle 20 to the processing unit 32 wirelessly. The processing unit 32 may include a computer and/or processor 38, and include all software, hardware, memory, algorithms, connections, sensors, etc., to manage and control the operation of the engine 22, including the lubrication system 24. As such, a method, described below and generally shown in FIG. 2, may be embodied as a program or algorithm operable on the processing unit 32. It should be appreciated that the processing unit 32 may include a device capable of analyzing data from various sensors, comparing data, making the decisions required to control the operation of the engine 22 and lubrication system 24, and executing the required tasks to control the operation of the engine 22 and lubrication system 24.

The processing unit 32 may be embodied as one or multiple digital computers or host machines each having one or more processors 38, read only memory (ROM), random access memory (RAM), electrically-programmable read only memory (EPROM), optical drives, magnetic drives, etc., a high-speed clock, analog-to-digital (A/D) circuitry, digital-to-analog (D/A) circuitry, and a required input/output (I/O) circuitry, I/O devices, and communication interfaces, as well as signal conditioning and buffer electronics.

The computer-readable memory may include a non-transitory/tangible medium which participates in providing data or computer-readable instructions. Memory may be non-volatile or volatile. Non-volatile media may include, for example, optical or magnetic disks and other persistent memory. Example volatile media may include dynamic random access memory (DRAM), which may constitute a main memory. Other examples of embodiments for memory include a floppy, flexible disk, or hard disk, magnetic tape or other magnetic medium, a CD-ROM, DVD, and/or a other optical medium, as well as other possible memory devices such as flash memory.

The processing unit 32 includes a tangible non-transitory memory 40 having computer executable instructions recorded thereon, including a lubrication system diagnostic algorithm 42. The processor 38 of the processing unit 32 is operable to execute the lubrication system diagnostic algorithm 42. The lubrication system diagnostic algorithm 42 implements a method of diagnosing the lubrication system 24 of the engine 22, described below.

A vehicle controller, which may include the processing unit 32, controls the oil pump 28 via the value of the control signal to provide a desired lubrication fluid pressure for a current set of operating conditions of the engine 22. The processing unit 32 receives input from the pressure sensor 34 and the temperature sensor 36 regarding the actual lubrication fluid pressure in the oil gallery 26 and the temperature of the lubrication fluid that the oil pump 28 generated for that value of the control signal. The vehicle controller, such as but not limited to the processing unit 32, may adjust the value of the control signal to achieve the desired lubrication fluid pressure for the current operating conditions of the engine 22. For various different reasons, for specific operating conditions of the engine 22, the actual lubrication fluid pressure in the oil gallery 26 generated by the oil pump 28 may change over time. Accordingly, by tracking the change in the value of the control signal for specific operating conditions of the engine 22, the processing unit 32 may identify when a change in the lubrication system 24 is affecting the lubrication fluid pressure. By analyzing the value of the control signal during different operating conditions, the processing unit 32 may isolate or identify specific components of the lubrication system 24 that may be responsible for the change in the lubrication fluid pressure, and that may require service or attention.

Figure 2:
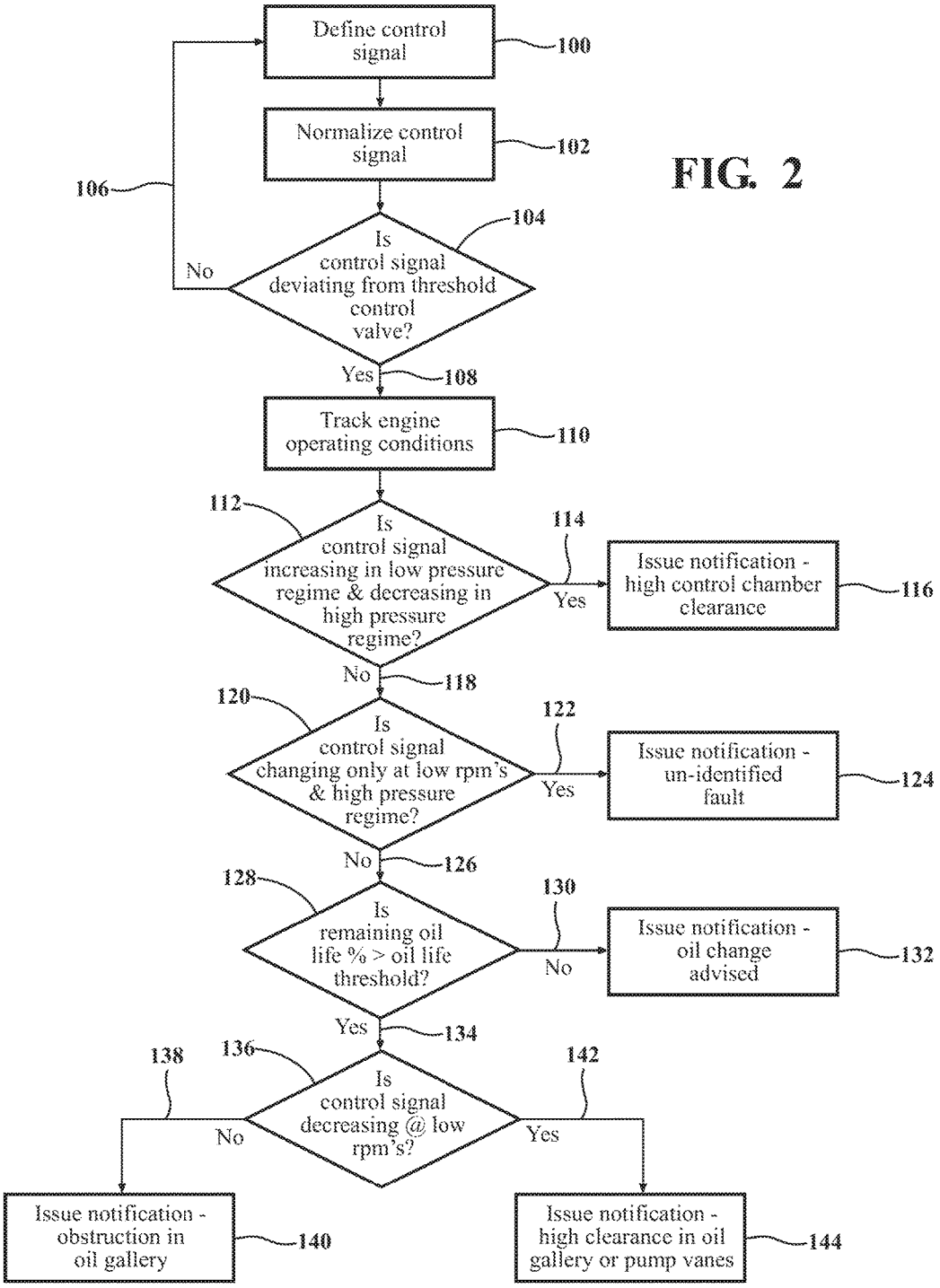
FIG. 2 is a flow chart representing a method of diagnosing a lubrication system of an engine.

As noted above, the process of the processing unit 32 executes the lubrication system diagnostic algorithm 42 to implement the method of diagnosing the lubrication system 24 of the engine 22. Referring to FIG. 2, the method of diagnosing the lubrication system 24 includes defining a value for a control signal for a current operating state of the engine 22. The step of defining the value for the control signal for the current operating state of the engine 22 is generally indicated by box 100 in FIG. 2. The control signal is a command, having a value, for the oil pump 28 to operate in a certain manner in order to provide a desired lubrication fluid pressure in the oil gallery 26. The processing unit 32 receives input from various sensors and/or other control modules, and defines the value of the control signal based on a desired lubrication fluid pressure for the current operating state of the engine 22. Different operating states of the engine 22 require different lubrication fluid pressures, and therefore a vehicle controller defines the current value for the control signal for the oil pump 28 based on the current operating state of the engine 22. As the current operating state of the engine 22 changes, the vehicle controller changes the value of the control signal for the oil pump 28 to provide a different lubrication fluid pressure. The vehicle controller communicates the control signal to the oil pump 28 in order to control the oil pump 28 with the control signal.

The processing unit 32 compares the value of the control signal for the current operating state of the engine 22 to a threshold control value for the current operating state of the engine 22. The threshold control value for the current operating state of the engine 22 is a defined limit for the value of the control signal indicating an acceptable value of the control signal for the current operating state of the engine 22. The threshold control value may include a minimum or a maximum value, and may be stored in a table on the memory 40 of the processing unit 32. It should be appreciated that the value of the control signal for each different operating state of the engine 22 will have a respective threshold control value for that respective operating state of the engine 22. The processing unit 32 compares the value of the control signal to the threshold control value defined for the current operating state of the engine 22. The threshold control value is defined based on the lubrication fluid being a specific temperature. Because fluid pressure is directly related to temperature, in order to compare the value of the control signal to the threshold control value, the processing unit 32 normalizes the value of the control signal based on a current lubrication fluid temperature. The step of normalizing the value of the control signal is generally indicated by box 102 in FIG. 2. In other words, the processing unit 32 normalizes, i.e., adjusts, the value of the control signal to account for the difference between the actual temperature of the lubrication fluid in the oil gallery 26 and the temperature of the lubrication fluid at which the threshold control value was defined. The processing unit 32 may normalize the value of the control signal in a suitable manner.

As noted above, the processing unit 32 compares the value of the control signal for the current operating state of the engine 22 to the threshold control value for the current operating state of the engine 22 in order to determine if the value of the control signal for the current operating state of the engine 22 is substantially equal to the threshold control value for the current operating state of the engine 22, or if the value of the control signal for the current operating state of the engine 22 deviates from the threshold control value for the current operating state of the engine 22. The step of comparing the value of the control signal to the threshold control value is generally indicated by box 104 in FIG. 2. In some embodiments, the value of the control signal for the current operating state of the engine 22 may be considered to be substantially equal to the threshold control value for the current operating state of the engine 22 when the value of the control signal is within +/−15% of the threshold control value. In contrast, in some embodiments, the value of the control signal for the current operating state of the engine 22 may be considered to deviate from the threshold control value for the current operating state of the engine 22 when the value of the control signal is not within or exceeds +/−15% of the threshold control value. The percentage difference may vary. Accordingly, in other embodiments, the value of the control signal from the current operating state of the engine 22 is substantially equal to the threshold control value for the current operating state of the engine 22 when the value of the control signal is +/− a pre-defined percentage based on that specific application, and the value of the control signal from the current operating state of the engine 22 deviates from the threshold control value for the current operating state of the engine 22 when the value of the control signal is not within or exceeds +/− the pre-defined percentage for that specific application.

When the processing unit 32 determines that the value of the control signal for the current operating state of the engine 22 is substantially equal to the threshold control value for the current operating state of the engine 22, generally indicated at 106, the processing unit 32 takes no further action and begins the process again. However, when the processing unit 32 determines that the value of the control signal for the current operating state of the engine 22 does deviate from the threshold control value for the current operating state of the engine 22, generally indicated at 108, the processing unit 32 then analyzes the difference between value of the control signal and the control threshold value for different operating conditions of the engine 22 to identify a fault in the lubrication system 24.

In order to analyze the value of the control signal to identify a fault in the lubrication system 24, the processing unit 32 may track at least one operating condition of the engine 22 relative to the value of the control signal. The step of tracking the operating conditions of the engine 22 is generally indicated by box 110 in FIG. 2. The operating condition of the engine 22 may include at least one of a rotational speed of the engine 22, the desired lubrication fluid pressure from the oil pump 28, an actual lubrication fluid pressure from the oil pump 28, and a lubrication fluid temperature. Additionally, the processing unit 32 may track the operating conditions of the engine 22 for different values of the control signal for other operating states of the engine 22. Accordingly, the processing unit 32 tracks the operating conditions of the engine 22 for the different control signals for the different operating states of the engine 22.

The processing unit 32 uses the tracked data to analyze the value of the control signal in order to identify a fault in the lubrication system 24. In doing so, the processing unit 32 determines if the value of the control signal is greater than the threshold control value with the engine 22 operating in a low lubrication fluid pressure regime and if the value of the control signal is less than the threshold control value with the engine 22 operating in a high lubrication fluid pressure regime. In other words, the processing unit 32 determines if both conditions are met, i.e., if the value of the control signal is greater than the threshold control value with the engine 22 operating in the low lubrication fluid pressure regime and the value of the control signal is less than the threshold control value with the engine 22 operating in the high lubrication fluid pressure regime. The step of determining if the value of the control signal is greater than the threshold control value with the engine 22 operating in a low lubrication fluid pressure regime and if the value of the control signal is less than the threshold control value with the engine 22 operating in a high lubrication fluid pressure regime is generally indicated by box 112 in FIG. 2. As noted above, the desired lubrication fluid pressure may change for different operating states of the engine 22. For some operating states, the desired lubrication fluid pressure may be defined as a low lubrication fluid pressure regime. The low lubrication fluid pressure regime may vary for different embodiments, and may be dependent upon a rotational speed of the engine. For example, the low lubrication fluid pressure regime may be defined in terms of a maximum pressure for a specific rotational speed of the engine 22. For example, the low lubrication fluid pressure regime may be defined as a maximum pressure at a given rotational speed of the engine divided by three (Max Pressure/3). In other operating states, the desired lubrication fluid pressure may be defined as a high lubrication fluid pressure regime. The high lubrication fluid pressure regime may vary for different embodiments, and may be dependent upon a rotational speed of the engine. For example, the high lubrication fluid pressure regime may be defined in terms of a maximum pressure for a specific rotational speed of the engine 22. For example, the high lubrication fluid pressure regime may be defined as a maximum pressure at a given rotational speed of the engine multiplied by two thirds (Max Pressure*⅔).

When the processing unit 32 determines that the value of the control signal is greater than the threshold control value with the engine 22 operating in the low lubrication fluid pressure regime and that the value of the control signal is less than the threshold control value with the engine 22 operating in the high lubrication fluid pressure regime, generally indicated at 114, the processing unit 32 calculates a fault severity. The fault severity is a measure of the difference between the value of the control signal and the control threshold value for the current operating state of the engine 22. The fault severity may be calculated in a suitable manner, and may be expressed as a number or a percentage. For example, the fault severity may be expressed as the percent difference between the value of the control signal and the threshold control value.

When the processing unit 32 determines that the fault severity is greater than a severity threshold, and that the value of the control signal is greater than the threshold control value with the engine 22 operating in the low lubrication fluid pressure regime and that the value of the control signal is less than the threshold control value with the engine 22 operating in the high lubrication fluid pressure regime, then the processing unit 32 issues a notification indicating excessive control chamber clearance in the oil pump 28. The step of issuing the notification indicating excessive control chamber clearance in the oil pump 28 is generally indicated by box 116 in FIG. 2. The severity threshold is a limit of allowable variation in the difference between the value of the control signal and the threshold control value, represented by the fault severity. The severity threshold may be defined to be a suitable value based on the specific components of the lubrication system 24 and the engine 22, and may be application specific. Issuing the notification indicating excessive control chamber clearance in the oil pump 28 may include a process capable of conveying a message. For example, issuing the notification indicating excessive control chamber clearance in the oil pump 28 may include, but is not limited to, lighting a dash display code, sounding a warning signal, recording a diagnostic code bit in the memory 40 of the processing unit 32, contacting a remote third party to schedule maintenance, etc.

When the processing unit 32 determines that the value of the control signal is not greater than the threshold control value with the engine 22 operating in the low lubrication fluid pressure regime or that the value of the control signal is not less than the threshold control value with the engine 22 operating in the high lubrication fluid pressure regime, generally indicated at 118, then the processing unit 32 determines if the value of the control signal deviates from the threshold control value only at low rotational speeds of the engine 22 with the engine 22 operating in the high lubrication fluid pressure regime. In other words, the processing unit 32 determines if both conditions are met, i.e., if the value of the control signal deviates from the threshold control value only at low rotational speeds of the engine 22 and the engine 22 is operating in the high lubrication fluid pressure regime. The step of determining if the value of the control signal deviates from the threshold control value only at low rotational speeds with the engine 22 operating in the high lubrication fluid pressure regime is generally indicated by box 120 in FIG. 2. As noted above, the desired lubrication fluid pressure may change for different operating states of the engine 22. For some operating states, the desired lubrication fluid pressure may be defined as a low rotational speed of the engine 22. As used herein, the low rotational speed of the engine 22 is defined as a rotational speed of the engine 22 that is less than 1,500 revolutions per minute.

As described above, the value of the control signal is substantially equal to the threshold control value when the control signal is within +/−15% of the threshold control value, and the value of the control signal may be considered to deviate from the threshold control value when the value of the control signal is not within or exceeds +/−15% of the threshold control value.

When the processing unit 32 determines that the value of the control signal does not deviate from the threshold control value only at low rotational speeds of the engine 22 with the engine 22 operating in the high lubrication fluid pressure regime, generally indicated at 122, then the processing unit 32 issues a notification indicating an un-identified fault with the lubrication system 24. The step of issuing the notification indicating the un-identified fault with the lubrication system 24 is generally indicated by box 124 in FIG. 2. In other words, the processing unit 32 only issues the notification indicating the un-identified fault with the lubrication system 24 when the value of the control signal deviates from the threshold control value at times other than when the engine 22 is operating a low rotational speeds with the engine 22 operating in the high lubrication fluid pressure regime. Issuing the notification indicating the un-identified fault with the lubrication system 24 may include a process capable of conveying a message. For example, issuing the notification indicating the un-identified fault with the lubrication system 24 may include, but is not limited to, lighting a dash display code, sounding a warning signal, recording a diagnostic code bit in the memory 40 of the processing unit 32, contacting a remote third party to schedule maintenance, etc.

When the processing unit 32 determines that the value of the control signal deviates from the threshold control value only at low rotational speeds of the engine 22 with the engine 22 operating in the high lubrication fluid pressure regime, generally indicated at 126, then the processing unit 32 compares a remaining oil life percentage to an oil life threshold. The step of comparing the remaining oil life percentage to the oil life threshold is generally indicated by box 128 in FIG. 2. The remaining oil life percentage may be calculated in a suitable manner, and is often readily available to the processing unit 32 from other diagnostic programs. The oil life threshold is a limit indicating that the lubrication fluid should be changed. If the remaining oil life percentage is greater than the threshold, then an oil change is recommended. If the remaining oil life percentage is less than the threshold, then an oil change is not recommended.

The remaining oil life percentage is compared to the oil life threshold to determine if the remaining oil life percentage is greater than the oil life threshold, or if the remaining oil life percentage is not greater than the oil life threshold. When the processing unit 32 determines that the remaining oil life percentage is not greater than the oil life threshold, generally indicated at 130, then the processing unit 32 issues a notification indicating an advised oil change. The step of issuing the notification advising an oil change is generally indicated by box 132 in FIG. 2. Issuing the notification indicating an advised oil change may include a process capable of conveying a message. For example, issuing the notification indicating the advised oil change may include, but is not limited to, lighting a dash display code, sounding a warning signal, recording a diagnostic code bit in the memory 40 of the processing unit 32, contacting a remote third party to schedule maintenance, etc.

When the processing unit 32 determines that the remaining oil life percentage is greater than the oil life threshold, generally indicated at 134, then the processing unit 32 determines if the value of the control signal is less than the threshold control value at low rotational speeds of the engine 22. The step of determining if the value of the control signal is less than the threshold control value at low rotational speeds is generally indicated by box 136 in FIG. 2. In addition, when the processing unit 32 determines that the remaining oil life percentage is greater than the oil life threshold, then the processing unit 32 calculates a fault severity. As noted above, the fault severity is a measure of the difference between the value of the control signal and the control threshold value for the current operating state of the engine 22. The fault severity may be calculated in a suitable manner, and may be expressed as a number or a percentage. For example, the fault severity may be expressed as the percent difference between the value of the control signal and the threshold control value.

When the processing unit 32 determines that the value of the control signal is not less than the threshold control value at low rotational speeds of the engine 22, generally indicated at 138, and when the fault severity is greater than the severity threshold, then the processing unit 32 issues a notification indicating an obstruction in an oil gallery 26 of the engine 22. The step of issuing the notification indicating the obstruction in the oil gallery 26 is generally indicated by box 140 in FIG. 2. Issuing the notification indicating the obstruction in an oil gallery 26 of the engine 22 may include a process capable of conveying a message. For example, issuing the notification indicating an obstruction in an oil gallery 26 of the engine 22 may include, but is not limited to, lighting a dash display code, sounding a warning signal, recording a diagnostic code bit in the memory 40 of the processing unit 32, contacting a remote third party to schedule maintenance, etc.

When the processing unit 32 determines that the value of the control signal is less than the threshold control value at low rotational speeds of the engine 22, generally indicated at 142, and when the fault severity is greater than the severity threshold, then the processing unit 32 issues a notification indicating excessive clearance in an oil gallery 26 of the engine 22 or in vanes of the oil pump 28. The step of issuing the notification indicating excessive clearance in the oil gallery 26 or in the pump vanes is generally indicated by box 144 in FIG. 2. Issuing the notification indicating excessive clearance in the oil gallery 26 of the engine 22 or in the pump vanes of the oil pump 28 may include a process capable of conveying a message. For example, issuing the notification indicating excessive clearance in the oil gallery 26 of the engine 22 or in the pump vanes of the oil pump 28 may include, but is not limited to, lighting a dash display code, sounding a warning signal, recording a diagnostic code bit in the memory 40 of the processing unit 32, contacting a remote third party to schedule maintenance, etc.

The detailed description and the drawings or figures are supportive and descriptive of the disclosure, but the scope of the disclosure is defined solely by the claims. While some of the best modes and other embodiments for carrying out the claimed teachings have been described in detail, various alternative designs and embodiments exist for practicing the disclosure defined in the appended claims.

What is claimed is:

1. A method of diagnosing a lubrication system of an engine, the method comprising:

controlling an oil pump with a control signal, wherein the control signal is a command having a value for a desired lubrication fluid pressure from the oil pump for a current operating state of the engine;

comparing the value of the control signal for the current operating state of the engine to a threshold control value for the current operating state of the engine, with a processing unit, to determine if the value of the control signal for the current operating state of the engine is substantially equal to the threshold control value for the current operating state of the engine, or if the value of the control signal for the current operating state of the engine deviates from the threshold control value for the current operating state of the engine; and analyzing the value of the control signal, with the processing unit, to identify a fault in the lubrication system, when the value of the control signal for the current operating state of the engine deviates from the threshold control value for the current operating state of the engine.

2. The method set forth in claim 1, wherein analyzing the value of the control signal to identify a fault in the lubrication system includes tracking at least one operating condition of the engine relative to the value of the control signal.

3. The method set forth in claim 2, wherein the at least one operating condition of the engine includes at least one of a rotational speed of the engine, the desired lubrication fluid pressure from the oil pump, an actual lubrication fluid pressure from the oil pump, and a lubrication fluid temperature.

4. The method set forth in claim 1, further comprising normalizing the value of the control signal for the current operating state of the engine based on a current lubrication fluid temperature.

5. The method set forth in claim 1, wherein the value of the control signal for the current operating state of the engine is substantially equal to the threshold control value for the current operating state of the engine when the value of the control signal is within +/−15% of the threshold control value.

6. The method set forth in claim 1, wherein analyzing the value of the control signal to identify a fault in the lubrication system includes determining, with the processing unit, if the value of the control signal is greater than the threshold control value with the engine operating in a low lubrication fluid pressure regime and if the value of the control signal is less than the threshold control value with the engine operating in a high lubrication fluid pressure regime.

7. The method set forth in claim 6, wherein analyzing the value of the control signal to identify a fault in the lubrication system includes calculating a fault severity, with the processing unit, when the value of the control signal is greater than the threshold control value with the engine operating in the low lubrication fluid pressure regime and when the value of the control signal is less than the threshold control value with the engine operating in the high lubrication fluid pressure regime.

8. The method set forth in claim 7, wherein analyzing the value of the control signal to identify a fault in the lubrication system includes issuing a notification, with the processing unit, indicating excessive control chamber clearance in the oil pump, when the fault severity is greater than a severity threshold.

9. The method set forth in claim 6, wherein analyzing the value of the control signal to identify a fault in the lubrication system includes determining, with the processing unit, if the value of the control signal deviates from the threshold control value only at low rotational speeds of the engine with the engine operating in the high lubrication fluid pressure regime, when the value of the control signal is not greater than the threshold control value with the engine operating in the low lubrication fluid pressure regime or the value of the control signal is not less than the threshold control value with the engine operating in the high lubrication fluid pressure regime.

10. The method set forth in claim 9, wherein analyzing the value of the control signal to identify a fault in the lubrication system includes issuing a notification, with the processing unit, indicating an un-identified fault with the lubrication system when the value of the control signal does not deviate from the threshold control value only at low rotational speeds of the engine with the engine operating in the high lubrication fluid pressure regime.

11. The method set forth in claim 9, wherein analyzing the value of the control signal to identify a fault in the lubrication system includes comparing a remaining oil life percentage to an oil life threshold, with the processing unit, to determine if the remaining oil life percentage is greater than the oil life threshold, or if the remaining oil life percentage is not greater than the oil life threshold, when the value of the control signal deviates from the threshold control value only at low rotational speeds of the engine with the engine operating in the high lubrication fluid pressure regime.

12. The method set forth in claim 11, wherein analyzing the value of the control signal to identify a fault in the lubrication system includes issuing a notification, with the processing unit, indicating an advised oil change when the remaining oil life percentage is not greater than the oil life threshold.

13. The method set forth in claim 11, wherein analyzing the value of the control signal to identify a fault in the lubrication system includes calculating a fault severity, with the processing unit, when the remaining oil life percentage is greater than the oil life threshold.

14. The method set forth in claim 13, wherein analyzing the value of the control signal to identify a fault in the lubrication system includes determining, with the processing unit, if the value of the control signal is less than the threshold control value at low rotational speeds of the engine, when the remaining oil life percentage is greater than the oil life threshold.

15. The method set forth in claim 14, wherein analyzing the value of the control signal to identify a fault in the lubrication system includes issuing a notification, with the processing unit, indicating an obstruction in an oil gallery of the engine, when the value of the control signal is not less than the threshold control value at low rotational speeds of the engine, and when the fault severity is greater than a severity threshold.

16. The method set forth in claim 14, wherein analyzing the value of the control signal to identify a fault in the lubrication system includes issuing a notification, with the processing unit, indicating excessive clearance in an oil gallery of the engine or in pump vanes of the oil pump, when the value of the control signal is less than the threshold control value at low rotational speeds of the engine, and when the fault severity is greater than a severity threshold.

17. A vehicle comprising:

an engine having an oil gallery;

a lubrication system having an oil pump operable in response to a control signal to circulate a lubrication fluid through the oil gallery of the engine;

a processing unit connected to the oil pump, wherein the processing unit includes a processor and a memory having a lubrication system diagnostic algorithm stored therein, wherein the processor is operable to execute the lubrication system diagnostic algorithm to:

track a value of the control signal relative to different operating conditions of the engine, wherein the different operating conditions of the engine include at least one of a rotational speed of the engine, a desired lubrication fluid pressure from the oil pump, an actual lubrication fluid pressure from the oil pump, and a lubrication fluid temperature;

normalize the value of the control signal for a current operating state of the engine based on a current lubrication fluid temperature;

compare the value of the control signal for the current operating state of the engine to a threshold control value for the current operating state of the engine to determine if the value of the control signal for the current operating state of the engine is substantially equal to the threshold control value for the current operating state of the engine, or if the value of the control signal for the current operating state of the engine deviates from the threshold control value for the current operating state of the engine; and analyze the value of the control signal to identify a fault in the lubrication system when the value of the control signal for the current operating state of the engine deviates from the threshold control value for the current operating state of the engine.

18. The vehicle set forth in claim 17, wherein the processor is operable to execute the lubrication system diagnostic algorithm to:

determine if the value of the control signal is greater than the threshold control value when the engine is operating in a low lubrication fluid pressure regime, and if the value of the control signal is less than the threshold control value when the engine is operating in a high lubrication fluid pressure regime;

calculate a fault severity when the value of the control signal is greater than the threshold control value with the engine operating in the low lubrication fluid pressure regime and when the value of the control signal is less than the threshold control value with the engine operating in the high lubrication fluid pressure regime; and issue a notification indicating excessive control chamber clearance in the oil pump, when the fault severity is greater than a severity threshold.

19. The vehicle set forth in claim 18, wherein the processor is operable to execute the lubrication system diagnostic algorithm to:

determine if the value of the control signal deviates from the threshold control value only at low rotational speeds of the engine with the engine operating in the high lubrication fluid pressure regime, when the value of the control signal is not greater than the threshold control value with the engine operating in the low lubrication fluid pressure regime or the value of the control signal is not less than the threshold control value with the engine operating in the high lubrication fluid pressure regime;

issue a notification indicating an un-identified fault with the lubrication system when the value of the control signal does not deviate from the threshold control value only at low rotational speeds of the engine with the engine operating in the high lubrication fluid pressure regime;

compare a remaining oil life percentage to an oil life threshold to determine if the remaining oil life percentage is greater than the oil life threshold, or if the remaining oil life percentage is not greater than the oil life threshold, when the value of the control signal deviates from the threshold control value only at low rotational speeds of the engine with the engine operating in the high lubrication fluid pressure regime;

issue a notification indicating an advised oil change when the remaining oil life percentage is not greater than the oil life threshold; and calculate a fault severity when the remaining oil life percentage is greater than the oil life threshold.

20. The vehicle set forth in claim 19, wherein the processor is operable to execute the lubrication system diagnostic algorithm to:

determine if the value of the control signal is less than the threshold control value at low rotational speeds of the engine, when the remaining oil life percentage is greater than the oil life threshold;

issue a notification indicating an obstruction in the oil gallery of the engine, when the value of the control signal is not less than the threshold control value at low rotational speeds of the engine, and when the fault severity is greater than a severity threshold; and issue a notification indicating excessive clearance in the oil gallery of the engine or in pump vanes of the oil pump, when the value of the control signal is less than the threshold control value at low rotational speeds of the engine, and when the fault severity is greater than a severity threshold.

* * * * *